United States Patent [19]

Driver et al.

[11] 4,380,118

[45] Apr. 19, 1983

[54] TERMINAL INSERTION TOOL

[75] Inventors: Donald E. Driver, Shermanstown; John W. Kaufman, Hershey, both of Pa.

[73] Assignee: AMP Incorporated, Harrisburg, Pa.

[21] Appl. No.: 292,564

[22] Filed: Aug. 13, 1981

[51] Int. Cl.[3] ..... H01R 43/00

[52] U.S. Cl. ..... 29/747; 29/758; 29/881; 29/884

[58] Field of Search ..... 29/739, 747, 758, 764, 29/844, 845, 884, 881, 882, 566, 564.1, 33 M

[56] References Cited

U.S. PATENT DOCUMENTS

| | | | |
|---|---|---|---|
| 2,976,608 | 3/1961 | Busler | 29/764 |
| 3,074,155 | 1/1963 | Cootes et al. | 29/739 |
| 3,800,416 | 4/1974 | Shultz et al. | 29/845 |
| 3,875,636 | 4/1975 | Shultz et al. | 29/739 |
| 4,070,755 | 1/1978 | Carter | 29/764 |
| 4,077,694 | 3/1978 | Cobaugh et al. | 339/176 MP |
| 4,083,101 | 4/1978 | Coller | 29/739 |
| 4,089,104 | 5/1978 | Barry et al. | 29/739 X |
| 4,186,982 | 2/1980 | Cobaugh et al. | 339/17 C |

*Primary Examiner*—Carl E. Hall

*Attorney, Agent, or Firm*—Russell J. Egan

[57] ABSTRACT

A hand tool is disclosed for separately inserting individual replacement terminals into a board mounted connector, the terminals having an active portion for electrically and mechanically engaging the board. The tool has an insertion head with a trident profile formed by two slots between three tines. One tine engages the connector housing and serves as a guide, another tine engages a shoulder of the terminal to apply insertion force, and the last tine engages the free end of the terminal to hold it in a preloaded condition.

4 Claims, 5 Drawing Figures

TERMINAL INSERTION TOOL

The present invention relates to a hand tool for inserting individual terminals into a connector housing, the terminals having an active portion for electrically and mechanically engaging an associated circuit board and being inserted in the housing in a pre-loaded condition.

It is frequently the case that there is the need to replace an individual terminal in an electrical connector when a terminal has become damaged through careless or inadvertent mating of the connector members. The defective terminal is usually removed from the connector by means of a tool such as the extraction tools shown in U.S. Pat. Nos. 2,976,608 and 4,070,755. In each of these instances the extraction tool is designed to apply an impact force along a restricted path and will drive the terminal from its seated position. The replacement terminal would then be applied by means of an insertion tool such as that described in U.S. Pat. No. 3,074,155. The problem with the insertion tools known heretofore, is that there is not always a way in which the terminal can be applied in a pre-loaded condition and there is not always the assurance that the terminal will be properly oriented and aligned when inserted.

According to the present invention, therefore an insertion tool for inserting individual terminals into a connector in a pre-loaded condition is characterized in that the tool has a handle with a profiled insertion head on a free end thereof. The insertion head is profiled with a pair of parallel spaced slots forming a trident head of three profiled tines. The center tine is profiled to drivingly engage a shoulder of the terminal, one outside arm is profiled to form a terminal free end loading arm and the other outside arm forming a housing guide arm.

A particular advantage of the present invention is that it results in a tool for inserting individual terminals into a connector housing in a pre-loaded conditioning with assurance that the terminal will be properly and accurately seated, the tool being readily and economically manufacturable.

An embodiment of the present invention will now be described by way of example with reference to the accompanying drawings, in which.

Figure 2:
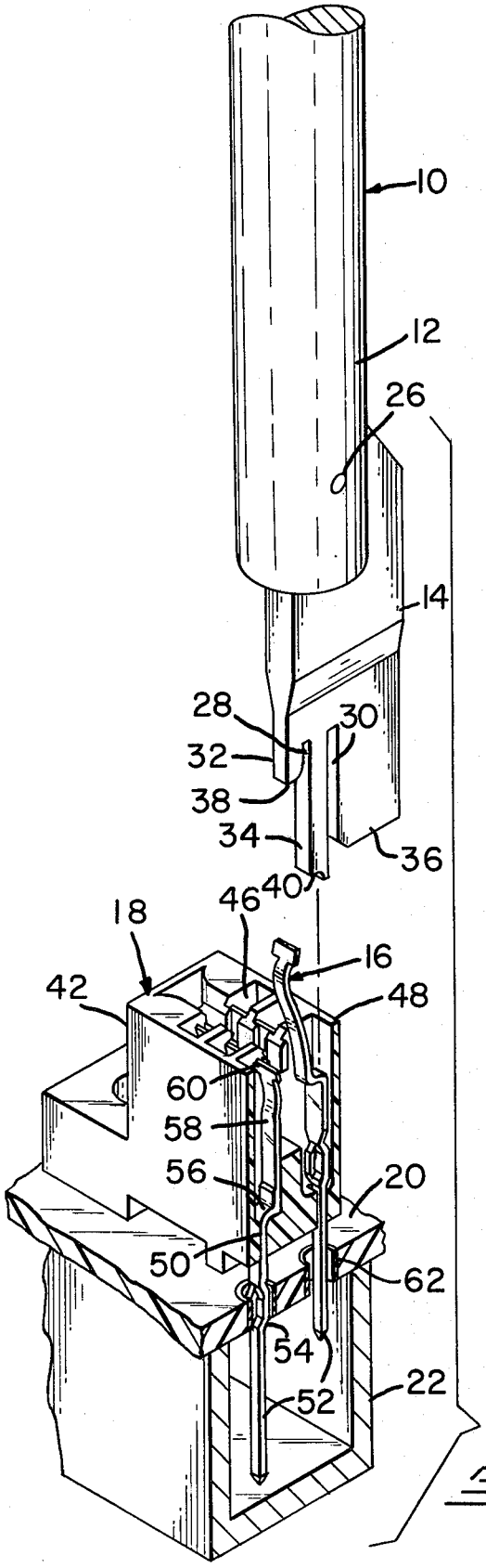
FIG. 2 is an exploded perspective view, partially in section, showing the subject tool spaced above an electrical connector and aligned to insert a replacement terminal therein.

The subject insertion tool 10 comprises a handle portion 12 and an insertion head 14 attached thereto.

The tool is used for inserting replacement terminals 16 into a connector 18 mounted on a circuit board 20. The circuit board 20 is mounted on a channel-shaped holding jig 22 during the insertion operation.

Figure 1:
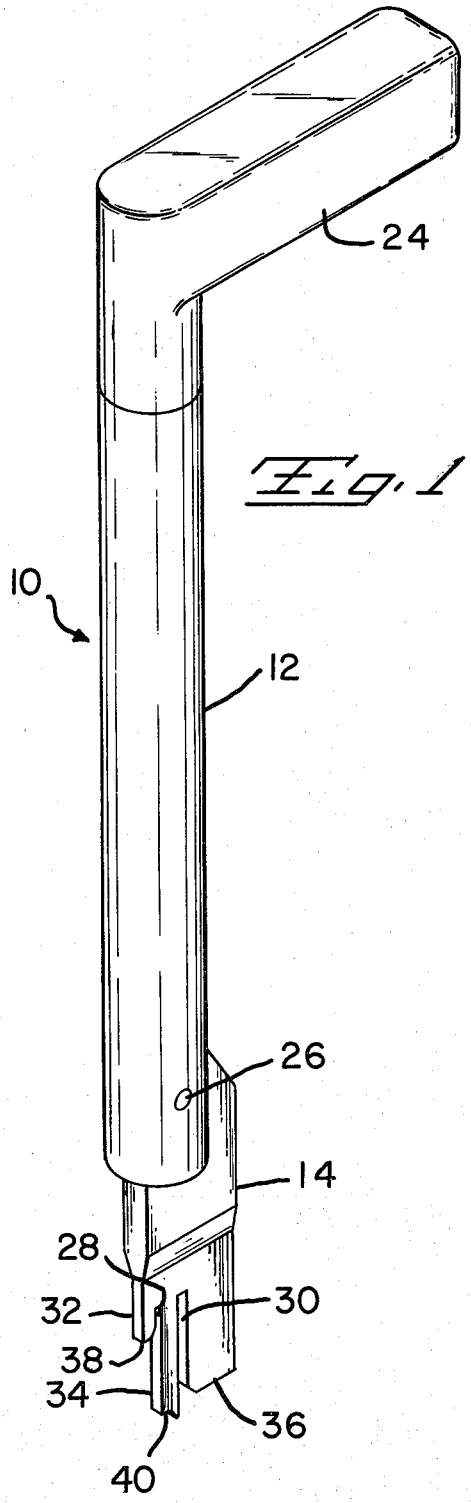
FIG. 1 is a perspective view of an insertion tool according to the present invention.

The handle 12 may be either straight or have an angled hand grip portion 24, as shown in FIG. 1. In either case, the handle is of elongated shape and is capable of withstanding an axial thrusting force. The insertion head 14 is secured to the end of the handle 12 by any conventional means, such as the pin 26 shown.

The insertion head 14 has a trident profile formed by parallel spaced slots formed by slots 28, 30 defining first arm 32, second arm 34, and third arm 36. The first arm 32 is relatively short and has a profiled end 38 designed to engage and pre-load the free end of terminal 16 in the slot 28. The second arm 34 has a profiled end 40 adapted to engage against a drive shoulder of the terminal 16. Slot 30 receives the edge of the housing 42, second arm 34 lying inside the housing and third arm 36 lying outside the housing to guide and align the tool and terminal during the insertion thrust.

The connector 18 is an insulative housing 42 of the type generally disclosed in U.S. Pat. No. 4,077,694, the disclosure of which is incorporated herein by reference. The housing 42 has an elongated central cavity 44 with a plurality of terminal recesses 46 opening therein from at least one side thereof forming thin sidewalls 48, which are received in slot 30 of the tool 10. Each terminal recess 46 has a through passage 50 at the bottom of the housing 42.

Each terminal 16 has a pin portion 52, an active mounting portion 54, which is here shown to be of the type disclosed in U.S. Pat. No. 4,186,982, an insertion shoulder 56, a contacting arm 58, and a pre-loaded extension 60 on the free end thereof.

Figure 3:
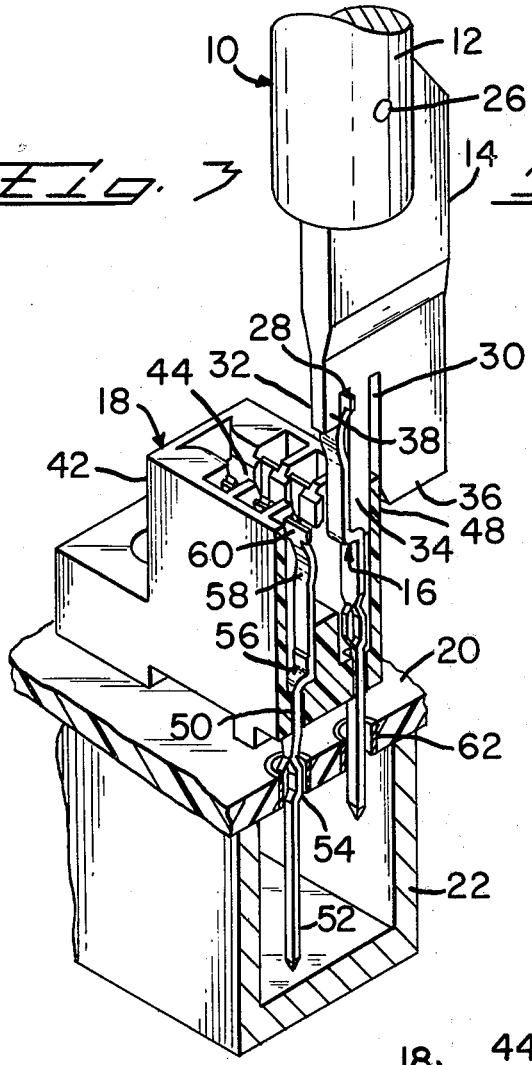
FIG. 3 is a view similar to FIG. 2 showing the subject tool engaging the replacement terminal prior to the insertion thereof into the housing.
Figure 4:
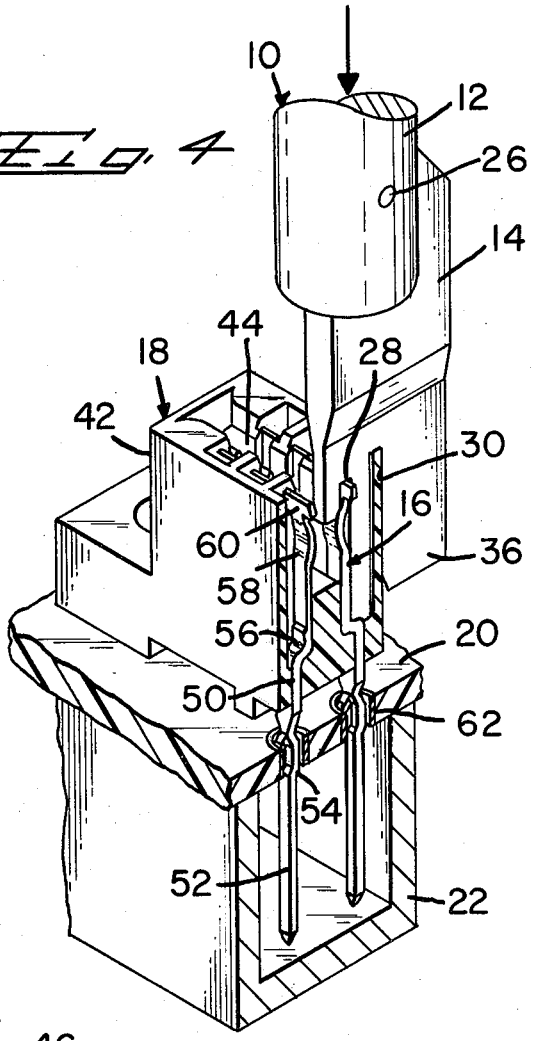
FIG. 4 is a view similar to FIGS. 2 and 3 showing the subject tool fully inserting the replacement terminal into the housing.
Figure 5:
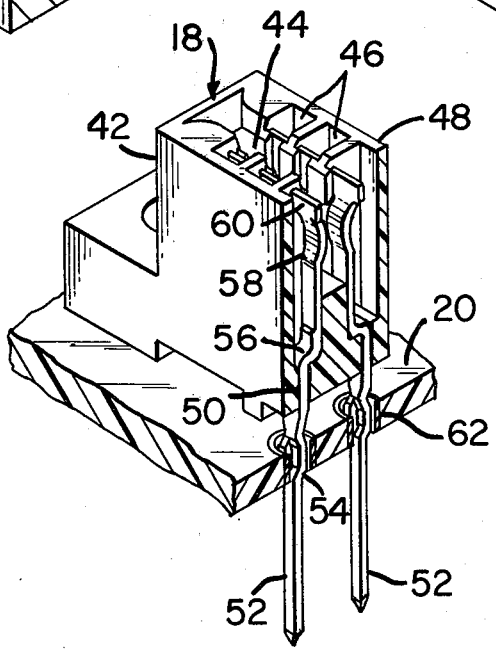
FIG. 5 is a perspective view of the housing showing the replacement terminal fully seated therein.

The subject tool is utilized in the following manner. The defective terminal 16 is removed from the housing 42 by one of the impact tools (not shown) previously mentioned. The impacting force is applied against the pin portion of 52 to drive the terminal 16 from the housing 42. The replacement terminal 16 is loosely dropped into position in the empty cavity 46 as shown in FIG. 2. The tool 10 is brought into engagement with the terminal as shown in FIG. 3 with the first arm 32 engaging the free profiled end 60 and holding it in a loaded condition in slot 28, the profiled end 40 of second arm 34 engages the shoulder 56 and the slot 30 receives the wall 48 of the housing 42. In this condition the active mounting portion 54 of the terminal 16 is spaced immediately above the passage 50 in the housing 42 and the plated-through hole 62 in the circuit board 20.

Continued downward force on the tool 10 will drive the terminal 16 to the seated condition in housing 42 and board 20 as shown in FIG. 3. It will be noted from FIG. 3 that the passage of the sidewall 48 along the slot 30 and the cavity 46 hold the terminal 16 in the correctly aligned position while making the insertion movement. It will also be seen that the mounting portion 54 has been driven fully into the plated hole 62 of the circuit board 20 to make good electrical and mechanical contact therewith.

We claim:

1. A hand tool for inserting individual replacement terminals into a housing of an electrical connector premounted on a circuit board, each said terminal having an active portion forming electrical and mechanical contact with a respective conductive hole in said board, an intermediate shoulder for receiving an axial thrust, and a free end profiled to be preloaded in said housing, said tool having a handle with an insertion head secured to one end thereof, characterized in that said insertion head has a trident configuration, the arms of which secure a free end of the replacement terminal in a preloaded condition, engage an intermediate shoulder of the terminal to apply an insertion force thereagainst, and engage said housing to guide the movement of the tool with respect thereto whereby said replacement terminal is inserted into the housing in a pre-loaded condition.

2. A hand tool according to claim 1 wherein said trident configuration is characterized by two parallel slots in said head defining three arms, one outside arm being substantially shorter than the other arms and being profiled to hold the free end of said replacement terminal in the adjacent slot in a preloaded condition.

3. A hand tool according to claim 1 wherein said trident configuration is characterized by two parallel slots in said head defining three arms, the center of said arms having a profile adapted to engage said shoulder of said terminal and impart axial thrust to said terminal.

4. A hand tool according to claim 1 wherein said trident configuration is characterized by two parallel slots in said head defining three arms, said housing being received in the slot between the center and an outer arm so that said tool moves in such direction as to only apply axial thrust to said replacement terminal.

* * * * *